United States Patent [19]

Zwerenz

[11] 4,184,044

[45] Jan. 15, 1980

[54] DRAWING PENCIL FOR USE WITH OPTICAL SCANNING APPARATUS

[75] Inventor: Dietmar Zwerenz, Asslar, Fed. Rep. of Germany

[73] Assignee: Ernst Leitz Wetzlar GmbH, Wetzlar, Fed. Rep. of Germany

[21] Appl. No.: 869,165

[22] Filed: Jan. 13, 1978

[30] Foreign Application Priority Data

Jan. 14, 1977 [DE] Fed. Rep. of Germany ... 7700959[U]

[51] Int. Cl.[2] ..... G08B 5/22; G08C 21/00

[52] U.S. Cl. ..... 178/18

[58] Field of Search ..... 178/18, 19, 20; 340/146.3 SY; 346/139 C; 33/1 M

[56] References Cited

U.S. PATENT DOCUMENTS

| | | | |
|---|---|---|---|
| 3,444,465 | 5/1969 | Teixeira | 178/19 |
| 3,462,548 | 8/1969 | Rinder | 178/18 |
| 3,528,295 | 9/1970 | Johnson et al. | 178/18 |
| 3,532,817 | 10/1970 | Jones et al. | 178/18 |

*Primary Examiner*—Thomas A. Robinson

*Attorney, Agent, or Firm*—Schwartz, Jeffery, Schwaab, Mack, Blumenthal & Koch

[57] ABSTRACT

Disclosed is a drawing pencil having a magnetic coil scanning element thereon for use with an optical analytic apparatus which scans a grid plate drawing table and converts an image thereon into an electrical signal. The magnetic coil scanning element is juxtaposed to the writing tip of the pencil such that its axis is inclined with respect to the axis of the drawing pencil, preferably such that in the normal writing position of the pencil the axis of the magnetic coil scanning element can be aligned perpendicularly to the surface of a drawing table.

17 Claims, 3 Drawing Figures

DRAWING PENCIL FOR USE WITH OPTICAL SCANNING APPARATUS

BACKGROUND OF THE INVENTION

The present invention relates to a drawing device having a magnetic coil scanning element, which is useful with optical instruments which scan an image on a drawing table, and convert the image into an electrical signal by means of an electronic evaluation means. With the aid of such a drawing device, preferably a pencil, an observer is capable of scanning a structural element on the grid plate designed drawing table and converting it into impulses which can be read on an evaluating instrument or stored.

For the determination of volumetric proportions or particle numbers, a microscope with a drawing tube is preferably used, which makes it possible to reflect the grid plate into the beam of the microscope. The observer is thus able to view the image of his object with the grid of the grid plate superimposed thereon. In addition, to the extent that it is passed over the grid plate, the drawing pencil is also recognizable.

The accuracy of these measurements is dependent on the precision with which the magnetic coil generating the impulses senses the image superimposed on the grid plate. In order to maximize the sensing ability of the magnetic coil, it is essential to bring the coil as close as possible to the writing tip. One approach to this problem has been to dispose the magnetic coil annularly around the drawing pencil in the immediate vicinity of the writing tip. With devices which do not possess a genuine drawing capability but contain only a scanning element, the foregoing problem is not encountered. There, the magnetic force field can be transmitted by a metallic pin. Such an arrangement cannot be utilized with genuine writing instruments. In such instruments, the magnetic coil must therefore be brought as close as possible to the writing tip of the instrument.

Drawing pencils with magnet coils mounted in an annular manner around the pencil suffer from the disadvantage, however, that they are only fully effective in the vertical position. In addition, with the drawing pencils known heretofore it is not possible to determine accurately whether the magnetic coil has been activated, due to the lack of any sensible or visible means of control. Moreover, with drawing pencils having an annularly mounted magnetic coil scanning element, the placement of the coil prevents complete utilization of the pencil lead. Accordingly, there exists a great need in the art for a drawing device for use with scanning apparatus which alleviates the foregoing disadvantages.

SUMMARY OF THE INVENTION

It is therefore an object of the instant invention to provide a drawing device having a scanning element thereon with improved scanning ability.

It is an additional object of the present invention to provide a drawing device for optical scanning purposes which has improved ease of use and can be utilized in a normal writing position.

It is a further object of the instant invention to provide a drawing device of the above-described type in which the scanning element does not prevent complete use of the pencil lead.

An additional object of the present invention is the provision of a drawing device of the present type having means to actuate the scanning element.

Still another object of the present invention is to provide a drawing device for use with scanning apparatus in which commercially available felt pens may be utilized.

Yet another object of the present invention is the provision of a drawing device of the above-described type which is more clearly visible during observation of the field of measurement.

In accordance with the present invention these and other objects are accomplished through the provision of a drawing device for use with optical analytical apparatus which comprises a drawing means having a writing tip portion; a magnetic coil scanning element juxtaposed to the writing tip of the drawing means along the longitudinal axis thereof; and means mounted on the drawing means for electrically connecting the magnetic coil scanning element to the electronic evaluation means of the apparatus.

In the preferred embodiment of the instant invention, the magnetic coil scanning element is juxtaposed to the writing tip of the drawing device such that its axis is inclined with respect to the axis of the drawing pencil, and more preferably such that in the normal writing position of the device the axis of the magnetic coil scanning element is perpendicularly aligned to the surface of the drawing table. Moreover, the drawing device of the present invention further includes an actuation means for the scanning element which affords the user an effective means for evaluating the activation of the device, as well as a pilot light mounted with the scanning element to improve the visibility thereof. The drawing device of the present invention may also comprise either a drawing pencil or alternatively may comprise a holder adapted to receive a conventional writing instrument, such as a felt pen.

Further objects, features, and advantages of the instant invention will become apparent to the skilled artisan upon examination of the following detailed description of the present invention, taken in conjunction with the figures of drawing.

DETAILED DESCRIPTION OF THE PREFERRED EMBODIMENTS

Figure 1:
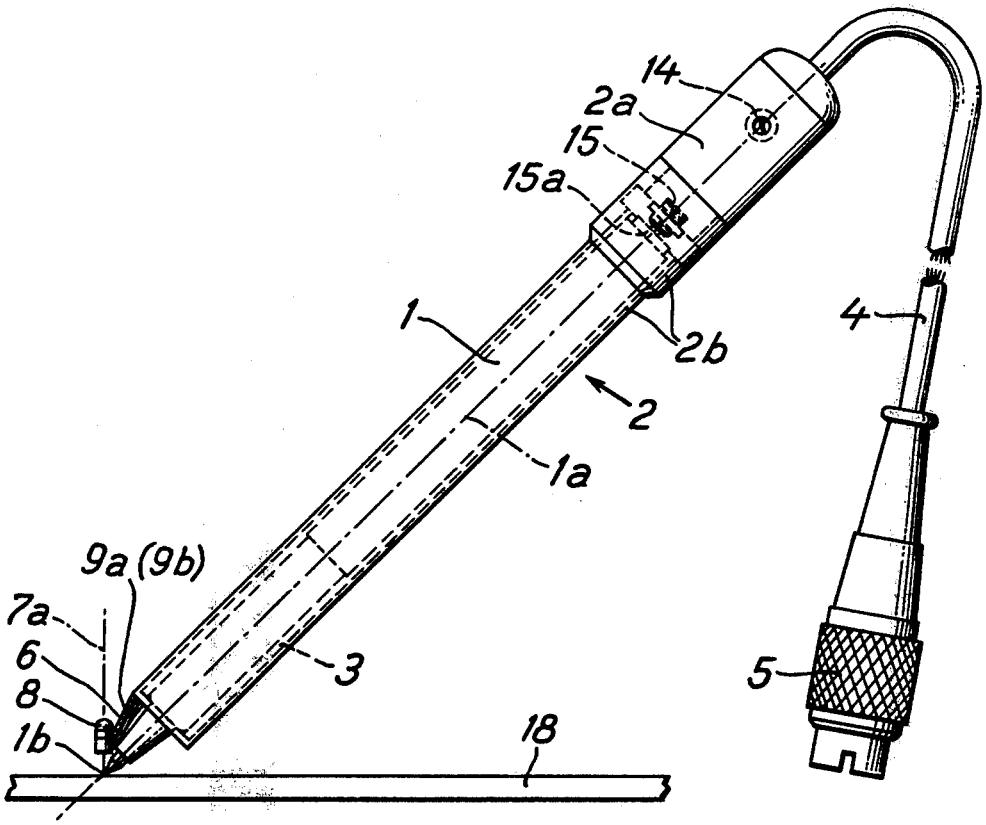
FIG. 1 is a perspective view of the drawing device of the instant invention.

In accordance with the inventive concepts of the instant invention, the disadvantages of the prior art are overcome by disposing the magnet coil outside the axis of the drawing pencil, preferably so that its axis is inclined with respect to the axis of the drawing pencil or its holder. The inclination is such that in the "normal" writing position of the drawing pencil the axis of the magnet coil can be aligned perpendicularly to the bearing surface of the drawing table, and to intersect with the tip of the writing pen in its operating position. This enables the scanning position of the coil to coincide exactly with the contact location of the drawing pencil.

In order to improve the visibility of the drawing pencil during microscopic observation, in accordance with the present invention, the magnet coil is utilized conjointly with a pilot light. The latter preferably comprises a light emitting diode, powered over the evaluating instrument. It is, however, also possible to provide a separate voltage source in the pen or holder itself. The magnet coil and the pilot light are preferably located in a tongue-shaped neck of the drawing device which extends toward the writing tip thereof. In the preferred embodiment, the drawing device preferably comprises a two-part holder with contact locations for an electric plug connection which is adapted to receive a conventional writing instrument. In a further embodiment of the instant invention, a head portion of the holder is designed to receive an electronic tuning device, which preferably comprises a potentiometer. This feature enables any potentially necessary corrections of the electric control parts of the analytical instrument to be performed without having to open the instruments for access. Additionally, the holder is designed so that commercially available felt pens can be replaceably inserted therein.

Figure 3:
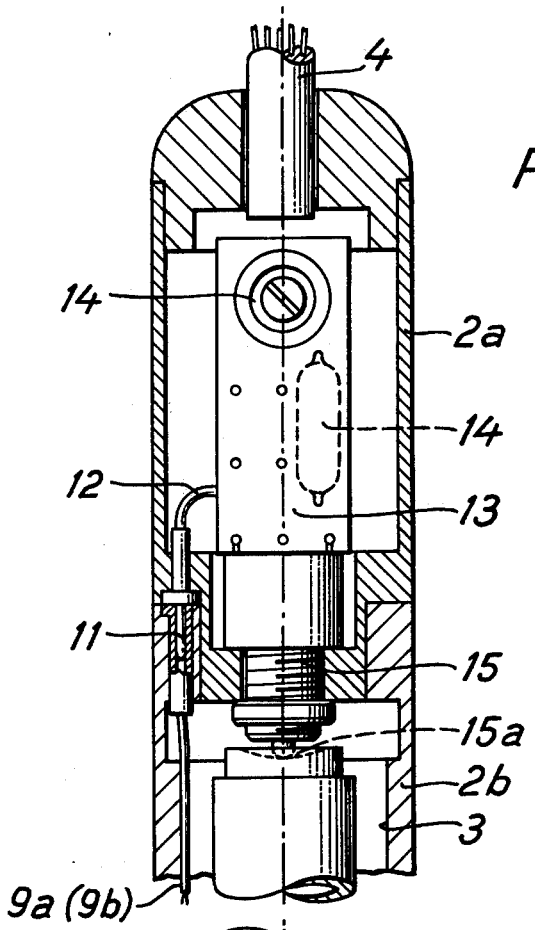
FIG. 3 is a longitudinal section of the head portion of one embodiment of the instant invention, again in enlarged representation.
Figure 2:
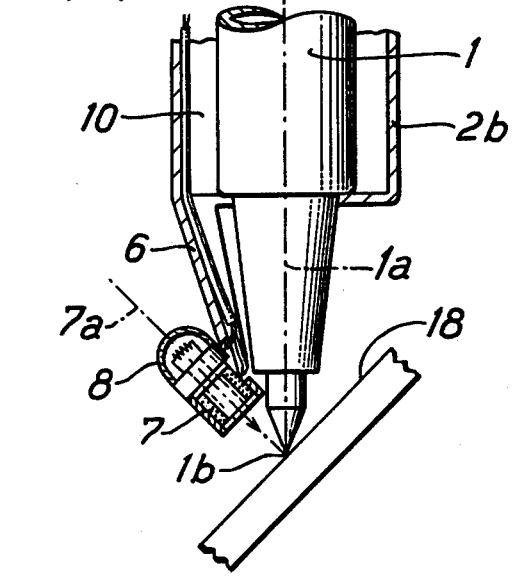
FIG. 2 is a longitudinal section of one embodiment of the instant invention, in an enlarged representation, illustrating the writing tip.

Referring to the drawings, FIGS. 1–3 illustrate the preferred embodiment of the instant invention in which the writing device comprises a holder 2, comprising head portion 2*a* and lower portion 2*b*, which is adapted to receive a commercially available writing instrument 1, such as a felt pen. The bore 3 of the holder corresponds to the dimensions of the pen 1. The head part 2*a* is designed to be detachable from the lower part 2*b* in order to permit the insertion and replacement of the pen 1 and has a bore at the lower end thereof for receiving the top end of the pen 1. The pen 1 is restrained within the lower part 2*b* by means of an integral apertured shoulder through which the writing tip 1*b* projects. A connecting cable 4 and plug connector 5 are provided for electrically connecting the holder head 2*a* to an evaluating instrument, not shown. The holder head 2*a* has a tongue-shaped butt strap 6, in which a magnet coil scanning element 7 and a pilot light 8 are mounted. This is shown in more detail in FIG. 2. The axis 7*a* of the annular magnet coil coincides with the axis of the pilot light and is inclined at an angle of 45° with respect to the axis 1*a* of the writing tip 1*b*. By means of this inclination, the axis 7*a* can be aligned perpendicularly to the writing support 18 of the optical scanning instrument when the pen 1 is in its normal writing position. The axis 7*a* intersects with the writing tip 1*b*.

Electric connecting wires 9*a* and 9*b* are provided for electrically connecting the magnet coil scanning element 7 and pilot light 8 with the evaluation instrument. The wires 9*a* and 9*b* pass through the narrow void 10 between the felt pen and the holder. FIG. 3 illustrates the use of a connecting plug 11 in order to make it possible to remove the holder head from the lower part 2*b*. A potentiometer 13, adjustable by means of screw 14, is provided in the holder head 2*a* and is electrically connected in series with the magnet coil 7 and pilot light 8 at 12. A microswitch 15 is also connected with the potentiometer at the lower end thereof which has a contact 15*a* in active contact with the felt pen 1. Contact of the felt pen with the support 18 activates the microswitch. The resulting click affords the user an effective means for evaluating the actual activation of the device.

While the invention has been described in terms of various preferred embodiments, the skilled artisan will appreciate that various modifications, substitutions, omissions and changes may be made without departing from the spirit thereof. Accordingly, it is intended that the scope of the present invention be limited solely by the scope of the following claims.

What is claimed is:

1. A drawing device for use with optical analytic apparatus having electronic evaluation means which scans a grid plate drawing table and converts an image thereon into an electric signal, comprising:

a. a drawing means having a writing tip portion, said writing tip portion defining said drawing means' longitudinal axis;

b. a magnetic coil scanning element having an axis thereof inclined with respect to said longitudinal axis of said writing tip portion of said drawing means; and c. means mounted on said drawing means for electrically connecting said magnetic coil scanning element to the electronic evaluation means.

2. The drawing device of claim 1, wherein said magnetic coil scanning element is arranged with respect to said writing tip portion such that its axis is aligned perpendicularly with said drawing table surface and intersects the tip portion of the drawing means when said drawing means is in its normal writing position.

3. The drawing device of claim 2, wherein said drawing means has a strap mounted thereon which extends towards said writing tip portion and carries said magnetic coil scanning element.

4. The drawing device of claim 3, further comprising a pilot light which is carried by the strap of said drawing means.

5. The drawing device of claim 4, wherein said pilot light is a light-emitting diode.

6. The drawing device of claim 5, wherein said light-emitting diode is coaxially mounted on said magnetic coil scanning element.

7. The drawing device of claim 4, wherein said drawing means further comprises an electrical adjustment device mounted therein which is electrically connected in series with said electrical connecting means and said magnetic coil scanning element.

8. The drawing device of claim 7, wherein said electrical adjustment device is a potentimeter.

9. The drawing device of claim 7, wherein said electrical adjustment device is also electrically connected in series with said light-emitting diode for supplying voltage thereto.

10. The drawing device of claim 7, further comprising means for actuating said magnetic coil scanning element.

11. The drawing device of claim 10, wherein said means for actuating said magnetic coil scanning element comprises a microswitch connected to said electrical adjustment device.

12. The drawing device of claim 10, wherein said drawing means comprises a conventional writing instrument having a writing tip and a holder adapted to replaceably receive said writing instrument and hold said instrument therein.

13. The drawing device of claim 12, wherein said writing instrument comprises a commercially available felt pen.

14. The drawing device of claim 12, wherein said holder comprises:

a. a head portion which contains said electrical adjustment device, said means for actuating said magnetic coil scanning element, and a plug connection member for detachably electrically connecting said electrical adjustment device with said diode and magnetic coil scanning element, said head portion also having a hole therein for receiving said electrical connecting means and a recessed portion at a lower end thereof for receiving an end portion of said writing instrument; and b. a lower portion having a bore therein adapted to the writing instrument's dimensions, an apertured shoulder which restrains said writing instrument within said holder and allows the writing tip to project therethrough, a plug connection member corresponding to said head portion plug connection member, for electrically connecting said electrical adjustment device with said diode and magnetic coil, and a neck piece which carries said light-emitting diode and said magnetic coil scanning element and extends toward the writing tip of said writing instrument.

15. The drawing device of claim 14, wherein said neck piece of said holder lower portion comprises a tongue shaped strap extending toward the writing tip of said writing instrument.

16. The drawing device of claim 14, wherein said actuating means is disposed below said electrical adjustment device such that upon the assembly of said head and lower holder portions with a writing instrument therein contact of the writing instrument with the drawing table actuates said actuating means.

17. The drawing device of claim 1, wherein said electrical connecting means comprises an electrically conducting cable and plug connector.

* * * * *